United States Patent [19]

Tokita

[11] Patent Number: 4,629,932

[45] Date of Patent: Dec. 16, 1986

[54] COLOR PICTURE TUBE HAVING A SHADOW MASK WITH A COALING LAYER

[75] Inventor: Kiyoshi Tokita, Fukaya, Japan

[73] Assignee: Kabushiki Kaisha Toshiba, Kawasaki, Japan

[21] Appl. No.: 672,951

[22] Filed: Nov. 19, 1984

[30] Foreign Application Priority Data

| | | | |
|---|---|---|---|
| Nov. 18, 1983 | [JP] | Japan | 58-216002 |
| Jan. 12, 1984 | [JP] | Japan | 59-2613 |
| Mar. 16, 1984 | [JP] | Japan | 59-49172 |
| Apr. 23, 1984 | [JP] | Japan | 59-80216 |

[51] Int. Cl.[4] ..... H01J 29/07

[52] U.S. Cl. ..... 313/402; 313/408; 313/423; 445/47

[58] Field of Search ..... 313/402, 408, 423, 403, 313/413; 445/47

[56] References Cited

U.S. PATENT DOCUMENTS

| | | | |
|---|---|---|---|
| 3,668,002 | 6/1972 | Okabe et al. | 313/402 X |
| 3,887,828 | 6/1975 | Bathelt | 313/402 |
| 4,065,695 | 12/1977 | Van Der Waal | 313/466 |
| 4,427,918 | 1/1984 | Lipp | 313/402 |
| 4,442,376 | 4/1984 | Van Der Waal et al. | 313/402 |

FOREIGN PATENT DOCUMENTS 0021502 1/1981 European Pat. Off. .

*Primary Examiner*—David K. Moore
*Assistant Examiner*—K. Wieder
*Attorney, Agent, or Firm*—Cushman, Darby & Cushman

[57] ABSTRACT

A color picture tube is disclosed, which comprises a phosphor screen, a shadow mask disposed near and facing the screen and having a main surface with a number of apertures, and electron guns for emitting electron beams passing through said apertures to bombard said screen and thereby selectively illuminating phosphors on the screen. The main surface of the shadow mask on the side of the electron guns is provided with a coating layer consisting of a material having a thermal expansion coefficient lower than those of the material of the shadow mask, and relatively low electrical conductivity, whereby doming of the shadow mask and miss-landing of electron beams can be suppressed.

12 Claims, 9 Drawing Figures

COLOR PICTURE TUBE HAVING A SHADOW MASK WITH A COALING LAYER

BACKGROUND OF THE INVENTION

The present invention relates to a a shaddow-mask-type color picture tube and, more particularly, to a shadow mask thereof.

In a shadow-mask-type color picture tube, shown in FIG. 1, an envelope formed of glass substantially consists of a rectangular panel 1, a funnel 2 and a neck 3. On an inner surface of the panel 1, for example, a stripe phosphor screen 4 which emits red, green and blue light is provided. On the other hand, in-line electron guns 6, which are linearly arranged along a horizontal axis of the panel 1 and emit three electron beams 10 corresponding to red, green and blue, are provided in the neck 3. A shadow mask 5 having a main surface portion in which a plurality of apertures are formed is disposed adjacent and opposed to the screen 4. A peripheral portion of the shadow mask 5 has a skirt portion 8, which is bent in correspondence with an outer shape of the panel 1. The skirt portion 8 is supported and fixed by a mask frame 7 consisting of a frame having an L-shaped cross-section. Furthermore, the mask frame 7 is engaged through a spring 9 with a pin (not shown), which is buried in an inner wall of the panel 1. In such a color picture tube, the three electron beams 10 emitted from the electron guns 6 are deflected by a deflection apparatus (not shown) provided near the funnel 2 of the outer portion of the envelope. The beams 10 are color-selected by the apertures of the shadow mask 5 while scanning a rectangular region substantially corresponding to the rectangular-shaped panel 1, and respectively and properly bombard the corresponding color-emitting phosphor stripes, thereby forming a color image.

In this case, an effective amount of the electron beam 10 passing through the apertures of the shadow mask 5 is less than $\frac{1}{3}$ of the total electron beam emitted from the electron guns 6. The remaining electron beam bombards the shadow mask 5 and is converted into heat energy. For this reason, the shadow mask 5 can be heated to about 80° C. The shadow mask 5 comprises a thin plate having a thickness of 0.1 to 0.3 mm and is formed of cold-rolled steel mainly consisting of iron having a relatively large thermal expansion coefficient of $1.2\times10^{-5}$/°C. The mask frame 7, which supports the skirt portion 8 of the shadow mask 5, is formed of the same cold-rolled steel as that of the shadow mask 5 and has a thickness of about 1 mm and an L-shaped cross-section. A surface of the mask frame 7 is oxidized, thereby forming a black oxide layer thereon. Thermal expansion of the shadow mask 5, which is heated by bombardment of the electron beam 10, can easily occur. However, since the peripheral portion of the shadow mask 5 is in contact with the mask frame 7, which has been subjected to darkening and has a large thermal capacity, heat is transferred to the mask frame 7 from the peripheral portion of the shadow mask 5 by radiation and conduction. Therefore, the temperature of the peripheral portion of the shadow mask 5 becomes lower than that of the central portion thereof. For this reason, a so-called doming occurs in which the central portion of the shadow mask 5 is thermally expanded by a greater extent than the peripheral portion thereof. By this doming, the relationship between the position of the apertures of the shadow mask 5 and that of the phosphor stripes formed corresponding to the apertures is changed. Therefore, a landing error occurs in which the electron beams 10 passing through the apertures do not bombard the proper phosphor stripes, resulting in degradation of color purity. Particularly, this doming is considerable at the initial operating phase of the color picture tube.

In addition, when there is a high brightness portion in the image and the portion is stationary for a certain period of time, the shadow mask is locally bombarded by electron beams of high electron current density, causing a local doming of the shadow mask.

With respect to such a doming in the initial operating phase of such a color picture tube, many suggestions have been made relating to prevention of thermal conduction to the shadow mask. For example, in the color picture tube disclosed in U.S. Pat. No. 3,887,828, a porous layer of manganese dioxide is deposited at a side of an electron gun of a shadow mask, and an aluminum layer and a nickel oxide or nickel-iron layer are sequentially formed thereon by vacuum evaporation. In this case, since the thermal conduction coefficient of the porous layer is extremely small, heat caused by bombardment of an electron beam is not transmitted to the shadow mask, but is radiated in a direction away from the shadow mask. For this reason, the temperature increase of the shadow mask can be effectively controlled.

However, this type of shadow mask is not so effective with respect to a local doming although it is effective with respect to a doming in the initial operating phase. In addition, to provide three layers on the shadow mask by vacuum evaporation, a great deal of equipment and long operation time are necessary. The process is therefore extremely undesired from the standpoint of industrial mass production.

Meanwhile, it has been proposed to alleviate miss-landing of electron beams on the side of the screen. For example, U.S. Pat. No. 4,065,695 discloses a structure in which an electron absorbing layer having a low electric conductivity is formed on nonluminous areas of a screen surface free from phosphor. Where the screen having such a structure is employed, a region of the screen where electron beams miss-land on the electron absorbing layer formed on the nonluminous area is also bombarded by electrons so that it is negatively charged. Consequently, local decelerating electric fields are generated between the screen and shadow mask. These electrical fields can serve to correct the trajectory of electron beams that are subject to miss-landing, thus reducing miss-landing. The screen of this structure, however, has the following drawbacks.

In the first place, the formation of an electron absorbing layer on non-luminous areas of the screen surface requires very elaborate equipment and many man-hours. More specifically, to form the electron absorbing layer, a thin precoat layer of polyvinyl alcohol is first formed on the screen surface using a 0.2-% aqueous soluton of polyvinyl alcohol. Then, a layer of a photosensitive suspension of aluminum oxide is formed on the precoat. The photosensitive suspension is prepared by pulverizing 300 g of granular aluminum oxide powder together with 33 g of polyvinyl alcohol, 0.8 g of ammonium bichromate and 1,025 ml of water using a ball mill. The photosensitive suspension becomes water-insoluble when it is exposed to light. The shadow mask with the photosensitive suspension layer is exposed three times using an annular light source having a center at the deflection point of the three electron beams. The exposure is effected for the nonluminous areas of the screen only. Subsequently, the unexposed portions of the photosensitive suspension layer in the water-soluble state are removed by spraying water, whereby an electron absorbing layer is formed on the nonluminous areas of the screen surface free from phosphor. This formation process of the electron absorbing layer requires substantially the same equipment and steps as those when forming luminous areas of screen with phosphors. Besides, if the electron absorbing layer is erroneously formed on the luminous areas as well due to difficient precision, for instance, it will reduce the light output from the luminous areas and, in an extreme case, cause extreme deterioration, as contamination spots on the phosphor screen, of the color picture tube. The structure, therefore, is very poor for industrial mass production from the standpoint of the preparation process and precision.

A second drawback is that a negatively charged portion of the electron absorbing layer, formed between adjacent phosphor regions which emit green, blue, and red light, is found only where electron beams miss-land, that is, it is limited to a very small area, too small to obtain a sufficient decelerating electric field for the electron beam trajectory correction. Further, the decelerating electric field effectively acts on electron beams only in a zone between the shadow mask and electron absorbing layer and very close to the latter, so that it can correct the electron beam trajectory only to a very small extent.

SUMMARY OF THE INVENTION

It is an object of the present invention to provide a color picture tube in which a doming of the shadow mask in the initial operation phase of a color picture tube is minimized, and the degradation of color purity due to miss-registration of electron beams can be prevented, and which has good mass-producibility.

According to the invention, there is provided a color picture tube, which comprises a phosphor screen, a shadow mask which is disposed close to and opposes the screen and has a main surface with a number of apertures, and electron guns for emitting electron beams that pass thorugh the shadow mask apertures to bombard the screen to cause selectively illuminating of phosphors on the screen. The main surface of the shadow mask on the side of the electron guns is provided with a coating layer of a material with a low thermal expansion coefficient, compared to the material of the shadow mask, and also with a relatively low electrical conductivity. The electrical conductivity of the material of the coating layer is preferably $10^{-12}$ to $10^{-5}$ $\Omega^{-1}m^{-1}$ in a temperature ranging from normal temperature to 200° C. Examples of the material having electrical conductivity in the range noted above are those mainly composed of lead borate glass containing $SnO_2$, $V_2O_5$ or Cu added thereto. The content of $SnO_2$ is 10 to 50% by weight. The content of $V_2O_5$ is 3 to 20% by weight. The content of Cu is 10 to 30% by weight.

The coating layer, mainly composed of lead borate glass containing the additive noted above, is chemically bonded to a black oxide layer formed on the shadow mask surface by a thermal treatment at a high temperature, e.g., 440° C.

DETAILED DESCRIPTION OF THE PREFERRED EMBODIMENT

Figure 1:
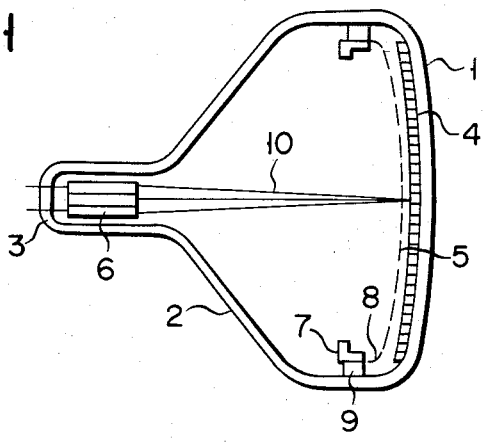
FIG. 1 is a sectional view showing a common shadow mask type color picture tube.

Now, a preferred embodiment of the invention will be described with reference to the drawings. The embodiment of the color picture tube according to the invention has the same structure as the prior art color picture tube shown in FIG. 1 except for the shadow mask, so its detailed description is omitted.

The main surface of the shadow mask 5 disposed near and opposing the screen 4 is provided on the electron-gun-side with a low conductivity coating layer composed of crystalline lead borate glass containing $SnO_2$ and having a relatively low electric conductivity. The crystalline lead borate glass containing $SnO_2$ consists of, for instance, nine parts by weight of lead borate glass containing approximately 80% by weight of PbO, approximately 10% by weight of $B_2O_3$, and approximately 5% by weight of $SiO_2$ and one part by weight of an additive consisting of approximately 95% by weight of $SnO_2$ and approximately 5% by weight of $Sb_2O_3$.

When coating such a lead borate glass on the main surface of the shadow mask, it is important to avoid clogging the apertures of the shadow mask and to form a coating layer having a uniform thickness. Therefore, brushing is not suitable as a method of coating lead borate glass. A method which is convenient and is suited for mass production is one in which a solution, obtained by dissolving lead borate glass in butyl acetate containing several % of nitrocelluloce dissolved therein, is coated by spraying.

The shadow mask with the lead borate glass coated on its main surface in the above way, is then placed on a predetermined frame and passed through a furnace at a maximum temperature of approximately 440° C. and with a retention period of over 35 minutes. Through this treatment, the low conductivity coating layer consisting of a lead borate glass containing the additive noted above is heat bonded to the electron-gun-side main surface of the shadow mask 5. More specifically, the coating layer is chemically bonded to the oxide layer on the shadow mask surface. The lead borate glass is vitrified if it contains 44 to 93% by weight of PbO. The PbO content which can ensure stabilization with respect to crystallization, however, is in a range of 70 to 85% by weight. This content range is thus suited for mass production. With the low conductivity coating layer consisting of lead borate glass with the additive, formed on the electron-gun-side main surface of the shadow mask 5 which is bombarded by electron beams, the surface of the coating layer is heated to more than 300° C. by the electron beam bombardment. For this reason, non-crystalline glass which will undergo volume flow at a temperature above the softening point (i.e., 350° to 600° C. with lead borate glass) is not suited, and it is preferable to use crystalline lead borate glass having a high resoftening point.

For crystallizing lead borate glass, a furnace which can hold a maximum temperature of 450° to 600° C. for more than 30 minutes is necessary. If the crystallization of lead borate glass is carried out concurrently with and in the same furnace for heat bonding the panel 1 and funnel 2, or if it is carried out concurrently with and in the same furnace for stabilizing the assembly of the shadow mask 5 and mask frame 7, there is no need to provide any separate heating furnace or any additional heating step, which is industrially very advantageous. Where the crystallization of glass is carried out concurrently with the bonding of the panel 1 and funnel 2, ZnO or CuO may be added, if necessary, to lead borate glass in order to match the conditions for the crystallization and those for the bonding. Doing so permits crystallization of lead borate glass to be obtained at a low temperature and without a substantial change in the thermal expansion coefficient.

The formation of the low conductivity coating layer on the electron-gun-side main surface of the shadow mask, as described above, requires no additional apparatus or elaborate equipment except for the provision of a spraying apparatus. In addition, the operation of spraying requires only about 30 seconds, as verified by experiments, so that it can be sufficiently carried out in the ordinary manufacturing process. The color picture tube structure according to the invention thus has a superior mass production property to that in the afore-described prior art example disclosed in the U.S. Pat. No. 4,065,695.

Figure 2:
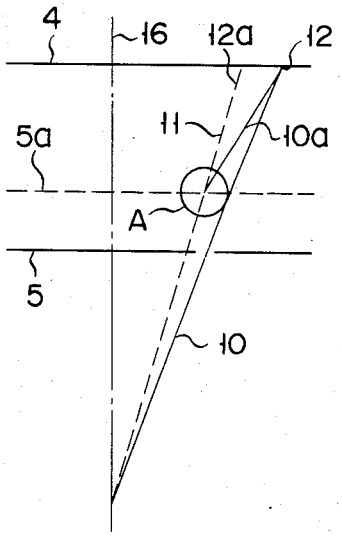
FIG. 2 is a view showing an trajectory of an electron beam in the vicinity of the shadow mask.
Figure 3:
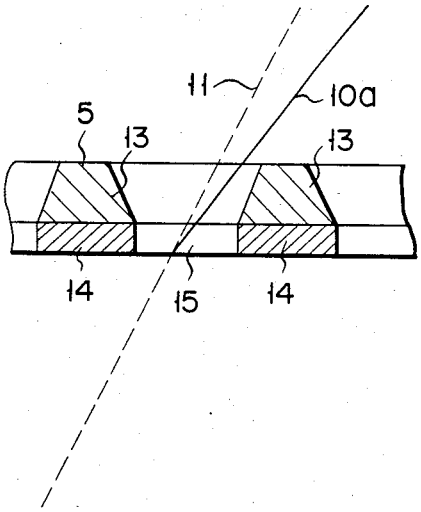
FIG. 3 is an enlarged-scale view of a portion A shown in FIG. 2.

The behavior of electron beams, when the color picture tube of the above construction according to the invention is operated, will now be described with reference to FIGS. 2 and 3. FIG. 3 is an enlarged scale view showing the area of portion A in FIG. 2, and in these figures like parts are designated by like reference numerals. Referring to FIG. 2, when the shadow mask 5 is free from doming, an electron beam 10 lands on a given point 12 of screen 4. When the sensity of the electron beam incident on the shadow mask 5 is increased, the shadow mask 5 undergoes a doming due to heating, that is, it is deformed to one as shown at position 5*a*. In this case, the trajectory of electron beam 10 is shifted toward the tube axis 16, resulting in a displacement of the landing point 12 on the screen 4 to a new point 12*a*. Due to this doming of the shadow mask, the electrom beam which is intended to land on the point 12 of the screen 4 now miss-lands on the point 12*a*. When the distance between the points 12 and 12*a* exceeds the limit of a margin for each color emitting phosphor group, the color purity is deteriorated.

With the color picture tube according to the invention, the electron-gun-side of the main surface portion of the shadow mask 5 is provided with the low conductivity coating layer 14, which has relatively low electrical conductivity, and this coating layer 14 is negatively charged by the bombardment of electron beams according to the current density thereof. The negative charge thus produced on the coating layer 14, particularly on that of the tube axis side, acts to deflect the electron beam trajectory 11 away from the tube axis 16, i.e., toward the trajectory 10*a*. This deflecting action has the effect of cancelling the doming of the shadow mask. More specifically, the electron beam that is deflected from the given landing point 12 of the screen 4 toward the tube axis 16 due to the doming is re-directed by the deflecting action of the negative charge so that it lands on the intended landing point 12. In this way, the negative charge can suppress or reduce the miss-landing of electron beams on the screen due to a doming of the shadow mask. Such action of suppressing the deflection of electron beams is obtained by virture of the formation of a negative charge distribution over the coating layer 14 in correspondence to the electron current density in every part of the main surface of the shadow mask 5.

This act of miss-landing suppression is weak enough with the order of electron current density during ordinary image reproduction and does not exceed the limit of the landing margin, but when a doming occurs, it provides its effect in co-operation with a doming suppression action to be described later. In addition, the coating layer is always bombarded by electron beams so long as the color picture tube is operative, so that its effective area of action is very large compared to the case of the prior art structure disclosed in U.S. Pat. No. 4,065,695. Further, the action of suppressing miss-landing may be thought to involve substantially no delay time.

As has been shown, the electron beam is deflected at the shadow mask, which is at a predetermined distance from the phosphor screen. Thus, it will be readily seen that the distance of displacement on the phosphor screen, caused by the deflecting action of the coating layer according to the invention, is far greater than is obtainable with the electron absorbing layer provided on the screen, as disclosed in U.S. Pat. No. 4,065,695, with the same amount of negative charge as the charging of the electron absorbing layer because of the longer distance of travel of electrons after the deflection. With the structure according to the invention, when the locally high electron current density disappears, the negative charge on the coating layer 14 must be reduced in correspondence to the disappearance of the shadow mask doming. The inventor has confirmed after various experiments that the negative charge on the coating layer 14 is reduced in correspondence to the disappearance of the shadow mask doming if the electrical conductivity of the coating layer is relatively low, i.e., from $10^{-12}$ to $10^{-5}\,\Omega^{-1}m^{-1}$ at a temperature in a range from normal temperature to 200° C. If the electrical conductivity of the coating layer is above $10^{-5}\,\Omega^{-1}m^{-1}$, the negative charging of the coating layer is insufficient. If the electrical conductivity is below $10^{-12}\,\Omega^{-1}m^{-1}$, on the other hand, the coating layer 14 nearly behaves like an insulating material, so that the negative charge on it will not disappear in a predetermined period of time in response to the disappearance of high electron current density. In either case, miss-landing of electron beams on the screen results.

Where the coating layer 14 is mainly composed of lead borate glass, its electrical conductivity may be varied by adding $SnO_2$ to lead borate glass. The content of $SnO_2$ as additive has to be suitably selected by taking the shape and size of the shadow mask and kind of tube into considerations. It may be in a range of 10 to 50% by weight in order to obtain an electrical conductivity in the range noted above. Experiments conducted by the inventor showed that the electrical conductivity of lead borate glass containing approximately 10% by weight of $SnO_2$ was approximately $10^{-12}\,\Omega^{-1}m^{-1}$, while that of lead borate glass containing approximately 50% by weight of $SnO_2$ was approximately $10^{-5}\ \Omega^{-1}m^{-1}$.

The invention has also confirmed after various experiments that the coating layer which provides an electrical conductivity of $10^{-12}$ to $10^{-1}\ \Omega^{-1}m^{-1}$ at a temperature ranging from normal temperature to 200° C., may be realized with borate series solder glass not only by adding $SnO_2$ but also by adding $V_2O_5$ or Cu. For example, by adding approximately 3% by weight of $V_2O_5$ to lead borate glass an electrical conductivity of approximately $10^{-12}\ \Omega^{-1}m^{-1}$ could be obtained at a normal temperature, and also an electrical conductivity at a normal temperature of approximately $10^{-5}\ \Omega^{-1}m^{-1}$ could be obtained by adding approximately 20% by weight of $V_2O_5$. In the case of Cu, an electrical conductivity at a normal temperature of approximately $10^{-12}\ \Omega^{-1}m^{-1}$ could be obtained by adding approximately 10% by weight, and of approximately $10^{-5}\ \Omega^{-1}m^{-1}$ by addition of approximately 30% by weight. In either case, the coating layer could be chemically bonded to the electron-gun-side main surface of the shadow mask in the same manner as in the case of adding $SnO_2$ to lead borate glass as described above, and also similar doming suppression effects and the suppression of miss-landing electron beams could be obtained.

According to the invention, a coating layer, which has the thermal expansion coefficient in the neighborhood of the temperature of heat bonding a shadow mask and the coating layer lower than that of the shadow mask, is chemically bonded to the shadow mask surface. Therefore, after the bonding there are residual tensile stress in the shadow mask and residual compression stress in the coating layer.

Figure 4A:
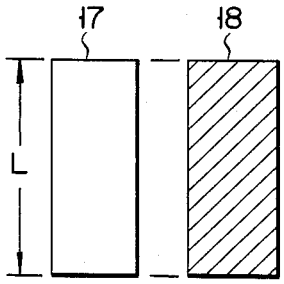
FIGS. 4A to 4C are views for explaining the phenomenon of heat bonding between glass and metal.
Figure 4B:
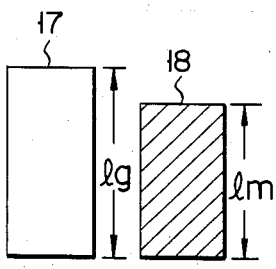
Figure 4C:
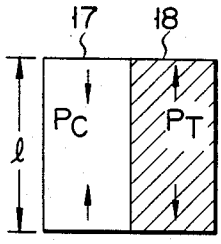

As shown in FIG. 4A, when a metal 18 and a glass 17 are heated to a high temperature, e.g., 440° C., before bonding, the length L of both materials is the same. In this state, as shown in FIG. 4B, when both materials are cooled to a normal temperature without bonding, since a thermal expansion coefficient of the metal is selected to be slightly larger than that of the glass, the relationship between both length becomes $lg > lm$. On the other hand, as shown in FIG. 4C, when the metal 18 and the glass 17 are bonded at a high temperature and are cooled to a normal temperature, the glass shrinks more under the influence of the metal. On the other hand, shrinkage of the metal is reduced due to bonding with the glass. Therefore, lengths at a normal temperature of these materials after bonding satisfy $lg > l > lm$. As a result, a compression stress Pc remains in the glass, and a tensile stress $P_T$ remains in the metal as residual stresses.

When the color picture tube having the structure as described above is operated, the temperature of the shadow mask is increased by the heat generated in the coating layer consisting essentially of lead borate glass which is bombarded by the electron beams. However, since the residual tensile stress acts on the shadow mask, thermal expansion of the shadow mask in the initial state can be considerably suppressed.

Figure 5:
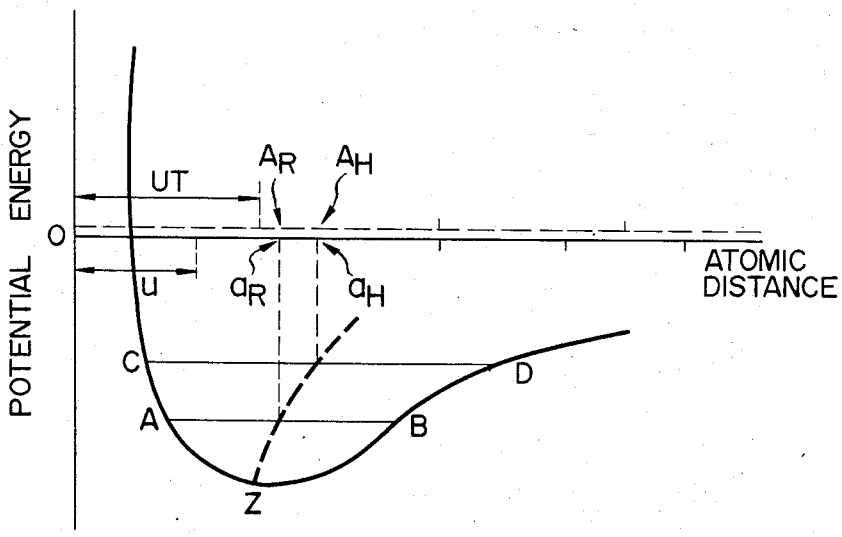
FIG. 5 is a view for explaining the phonomenon of thermal expansion of a solid material.

This mechanism will be described with reference to FIG. 5. FIG. 5 is a graph showing a potential energy existing between atoms (ordinate) as a function of a distance between atoms of material (abscissa). Since vibrations of atoms at a given temperature are not harmonic, a potential energy curve becomes asymmetrical with a potential energy point Z at absolute zero. Therefore, in FIG. 5, an average distance between atoms which respectively vibrate between positions corresponding to A and B at a normal temperature is given as $a_R$. Energy is increased in accordance with an increase in temperature, and if atoms vibrate at positions corresponding to C and D, an average distance between atoms becomes $a_H$ due to asymmetry of the potential energy curve. Therefore, atoms are displaced from their equilibrium positions in accordance with an increase in amplitude of vibration. An average displacement $\Delta l = a_H - a_R$ of atoms in a solid body is known to be the cause for thermal expansion.

There will now be described the thermal expansion of the shadow mask in the case where, as in the present invention, a residual tensile stress remains in the shadow mask by forming the coating layer on one surface of the shadow mask. In this case, the distance between atoms which constitute the shadow mask is extended by the residual tensile stress. If this is expressed using FIG. 5, the ordinate, i.e., an amount of potential energy, is constant, and the abscissa, i.e., a unit length of a distance between atoms, is extended from u to $u_T$ (new abscissa is shown by a dotted line). Therefore, thermal expansion of $a_H - a_R = \Delta l$ conventionally occurs by an increase in temperature of the shadow mask due to bombardment of electron beams (abscissa is shown by a solid line). However, in the shadow mask according to the present invention, since residual stress exists, thermal expansion of only $A_H - A_R = \Delta l_T$ occurs. As described above, since a unit length u of the abscissa shown by the solid line is smaller than a unit length $u_T$ of the abscissa shown by the dotted line, the relationship between a conventional thermal expansion amount $\Delta l$ and a thermal expansion amount $\Delta l_T$ according to the present invention becomes $\Delta l_T = (u/u_T) \times \Delta l$. Therefore, as is apparent from the above description, the thermal expansion amount $\Delta l_T$ of the shadow mask according to the present invention is smaller than that of the conventional one.

With normal glass, the compression strength is about 10 times the tensile strength. Therefore, it is desirable that there is slight compression stress in glass after the bonding. It is very suitable from this standpoint as well that a coating layer mainly composed of lead borate glass with a PbO content of 70 to 80% by weight and having a thermal expansion coefficient of 0.7 to $1.2 \times 10^{-5}$/°C. be bonded to a shadow mask consisting of a cold-rolled steel plate having a thermal expansion coefficient of $1.2 \times 10^{-5}$/°C.

Results of experiments conducted by the inventor will now be described. With a 21-inch type color picture tube, a crystalline lead borate glass layer, containing approximately 25% by weight of $SnO_2$ and having a thermal expansion coefficient of approximately $0.9 \times 10^{-5}$/°C. in the neighborhood of the heat bonding temperature, was heat-bonded to a thickness of approximately 15 μm on the electron-gun-side surface of a shadow mask consisting of a 0.18-mm thick cold-rolled steel plate and having a radius of curvature of the main surface in the horizontal direction of approximately 1,000 mm.

Such a color picture tube was operated at an anode voltage of 25 kV and an anode average current of 1,500 μA. The maximum displacement along a horizontal direction of the electron beams after vive minutes from the start of the operation was checked. A measuring point is a portion spaced about 140 mm apart from an image center along a horizontal direction at which the doming easily occurs. In this color picture tube, electron beams land on one phosphor stripe and two neighboring light-absorbing stripes (negative landing). Luminance is decreased by a constant displacement even if the landing point is not moved to the next phosphor stripe. Particularly, with reference to the green phosphor which considerably affects luminance, the landing tolerance of the electron beam of the electron gun is about 60 μm. In this color picture tube, the miss-landing amount of the electron beam was about 90 μm when the present invention was not adopted, and that of the electron beam according to the present invention was about 50 μm. Then, it was confirmed that the electron beam of the present invention was sufficiently within the allowed tolerance.

Figure 6:
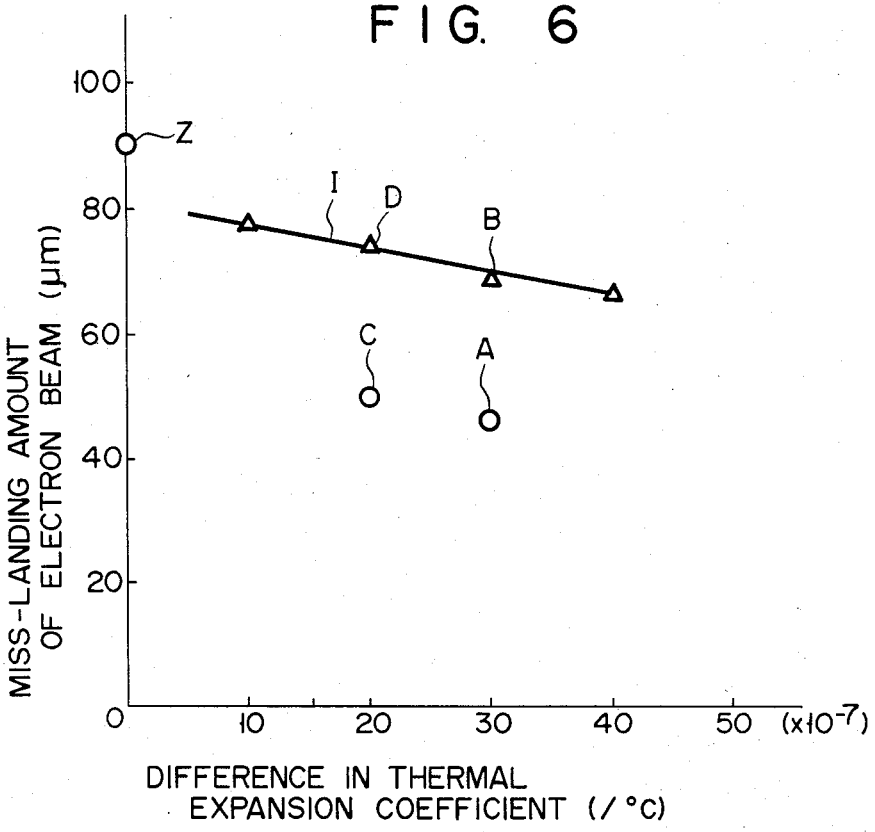
FIG. 6 is a graph showing the amount of miss-landing of electron beams according to the difference in the thermal expansion coefficient between the shadow mask and coating layer.

FIG. 6 shows the results of the above experiments. In FIG. 6, the ordinate is taken for the amount of miss-landing of electron beams, and the abscissa is taken for the difference in the thermal expansion coefficient in the neighborhood of the heat bonding temperature between the shadow mask and crystalline lead borate glass provided on the electron-gun-side of the shadow mask, in a color picture tube with the shadow mask consisting of a 0.18-mm thick cold-rolled steel plate. The amount of electron beam miss-landing in the color picture tube noted above according to the invention, in which the coating layer mainly composed of crystalline lead borate glass with an $SnO_2$ content of approximately 25% by weight is provided on the electron-gun-side of the shadow mask, is about 45 μm as shown at point A. The amount of electron beam miss-landing in a prior art color picture tube without a coating layer on the shadow mask surface is about 90 μm as shown at point Z. Line I represents the amount of electron beam miss-landing due to doming, which varies according to the difference in the thermal expansion coefficient in the neighborhood of the heat bonding temperature between the shadow mask and coating layer of a color picture tube proposed earlier by the inventor, in which a getter layer mainly composed of barium, for instance, is formed on the surface of a coating layer mainly composed of crystalline lead borate glass. It will be seen from the line I that with an increase of the thermal expansion coefficient, the tensile stress remaining in the shadow mask is increased to suppress the miss-landing of electron beams due to the doming of the shadow mask.

The electric conductivity at a normal temperature of the crystalline lead borate glass containing approximately 25% by weight of $SnO_2$, as used in the embodiment, is approximately $10^{-10}\ \Omega^{-1}m^{-1}$. When a layer having very high electric conductivity, e.g., a getter layer mainly composed of barium is formed on the surface of the glass layer, the electron beam miss-landing amount is increased to approximately 70 μm (point B) from approximately 45 μm (point A) in the absence of the getter layer. This means that one of the two effects of the invention, i.e., the effect of the low conductivity coating layer having relatively low electric conductivity formed on the electron-gun-side of the shadow mask to cause deflection of electron beams so as to suppress the incorrect landing of the electron beams due to doming, is completely lost due to the getter layer having a very high electric conductivity. That is, only the other effect of the invention appears, that is, the heat-bonding to the shadow mask of a glass layer having a lower thermal expansion coefficient at the heat bonding temperature than the shadow mask will produce a residual tensile stress in the shadow mask to suppress the doming of the shadow mask. If the difference in the thermal expansion coefficient at the heat bonding temperature between the shadow mask and glass layer, which is one feature of the invention to produce a residual tensile stress in the shadow mask so as to suppress doming thereof, is excessive, deformation of the shadow mask is liable to result from the residual tensile stress. Particularly, it has been found that the addition of $SnO_2$, $V_2O_5$ or Cu to lead borate glass for the purpose of adjustment of the electric conductivity thereof will generally reduce the thermal expansion coefficient thereof compared to a case where there is an absence of such additives. By way of example, while the thermal expansion coefficient of lead borate glass is approximately $1.0\times10^{-5}$/°C. as noted before, it will be increased to approximately $0.9\times10^{-5}$/°C. by adding 25% by weight of $SnO_2$. Therefore, it is presumable that the formation of a coating layer having a desired electric conductivity, obtained by adding, for instance, $SnO_2$ to lead borate glass on the electron-gun-side surface of shadow mask, will cause deformation thereof due to the excessive thermal expansion coefficient difference between the coating layer and shadow mask.

Figure 7:
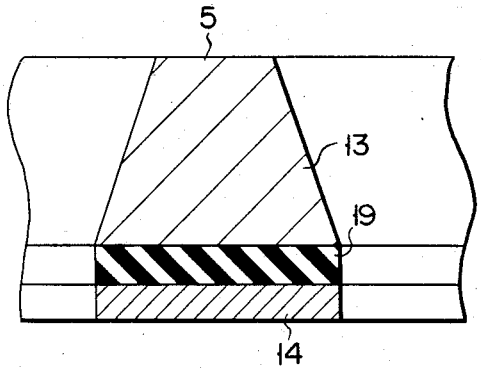
FIG. 7 is a sectional view showing a part of a shadow mask having a structure with an intermediate layer provided between the shadow mask and coating layer.

The inventor has confirmed that the deformation of the shadow mask can be prevented by forming, between shadow mask 13 and low conductivity coating layer 14 as shown in FIG. 7, an intermediate layer 19, the thermal expansion coefficient of which in the neighborhood of the heat bonding temperature is lower than that of the shadow mask 13 but higher than that of the low conductivity layer 14. In this case, the low conductivity layer 14 may be formed of lead borate glass containing $SnO_2$ or a similar additive, and the intermediate layer 19 may be made of lead borate glass. A 21-inch type color picture tube of the same structure as noted above, except that it has a shadow mask with the above structure, was produced, and the amount of electron beam miss-landing in this color picture tube was measured in the manner as described above to obtain a result as shown at point C (about 50 μm) in the graph of FIG. 6. With a color picture tube where a getter layer having a very high electric conductivity, mainly composed of barium, is formed on the low conductivity layer surface, the amount of electron beam miss-landing was substantially the same as at point D on the line I (about 75 μm) in FIG. 6. The formation between the shadow mask 13 and low conductivity layer 14 of the intermediate layer 19 having a thermal expansion coefficient slightly higher than that of the low conductivity layer 14 and lower than that of the shadow mask 13 actually reduces the residual tensile stress in the shadow mask to slightly reduce the electron beam miss-landing suppression effect. Nevertheless, the effect is obviously greatly improved over the prior art color picture tube.

The lead borate glass constituting the intermediate layer 19 has a very high insulating property, i.e., an electrical conductivity of $10^{-15}\ \Omega^{-1}m^{-1}$. When electron beams are directly bombarded on the lead borate glass layer 19, the layer 19 is charged and may influence the subsequent electron beams. For example, the trajectory of the electron beams changes. However, according to the present invention, since the low electrical conductivity layer 14 of an electrical conductivity of $10^{-12}$ to $10^{-5}\ \Omega^{-1}m^{-1}$ is formed on the surface of the lead borate glass layer 19 which is located at the side of the electrong gun, such as charge-up phenomenon can be prevented. In this case, the low electrical conductivity layer 14 must be electrically connected to the shadow mask. When the layer 14 is formed in a wide area exceeding the area of the lead borate glass layer 19, the layer 14 can be electrically connected to the shadow mask with ease. In this case, 5 μm thickness of the layer 14 suffices to electrically connect to the shadow mask. It was confirmed that such a thickness causes no deformation of the shadow mask.

As has been described in the foregoing, it is possible to provide a color picture tube which is excellent for industrial mass production and can effectively suppress the doming of the shadow mask and miss-landing of electron beams to thereby improve the color purity deterioration such as color deviation and color fluctuations without need of elaborate manufacturing equipment and also without an increase in the manufacturing time.

What is claimed is:

1. A color picture tube comprising:

a phosphor screen;

a shadow mask disposed near and facing said screen and having a main surface with a plurality of apertures; and electron guns for emitting electron beams passing through said apertures to bombard said screen and thereby selectively illuminating phosphors;

said main surface of said shadow mask on the side of said electron guns being provided with a coating layer consisting of a material having an electrical conductivity of from $10^{-12}$ to $10^{-5}$ $\Omega^{-1}m^{-1}$ at a temperature ranging from normal temperature to 200° C.

2. A color picture tube according to claim 1, wherein said coating layer contains lead borate glass as a main component.

3. A color picture tube according to claim 2, wherein said coating layer is chemically bonded to a surface of said shadow mask by a heat treatment.

4. A color picture tube according to claim 3, wherein the thermal expansion coefficient of said coating layer at the temperature of said heat treatment is lower than that of said shadow mask.

5. A color picture tube according to claim 2, wherein said lead borate glass contains $SnO_2$.

6. A color picture tube according to claim 5, wherein the content of said $SnO_2$ ranges from 10 to 50% by weight.

7. A color picture tube according to claim 2, wherein said lead borate glass contains $V_2O_5$.

8. A color picture tube according to claim 7, wherein the content of said $V_2O_5$ ranges from 3 to 20% by weight.

9. A color picture tube according to claim 2, wherein said lead borate glass contains Cu.

10. A color picture tube according to claim 9, wherein the content of said Cu ranges from 10 to 30% by weight.

11. A color picture tube according to claim 1, wherein an intermediate layer is formed between said shadow mask and said coating layer, said intermediate layer having a thermal expansion coefficient lower than that of said shadow mask and higher than that of said coating layer.

12. A color picture tube according to claim 11, wherein said coating layer substantially consists of lead borate glass containing at least one additive selected from a group consisting of $SnO_2$, $V_2O_5$ and Cu, and said intermediate layer substantially consists of lead borate glass.

* * * * *